United States Patent [19]

Brown

[11] Patent Number: 4,686,953

[45] Date of Patent: Aug. 18, 1987

[54] HIGH PERFORMANCE DISTRIBUTORLESS DIGITAL IGNITION SYSTEM FOR INTERNAL COMBUSTION ENGINES

[75] Inventor: Craig R. Brown, Phoenix, Ariz.

[73] Assignee: Stanley L. Dembecki, Phoenix, Ariz.

[21] Appl. No.: 880,140

[22] Filed: Jun. 30, 1986

Related U.S. Application Data

[63] Continuation-in-part of Ser. No. 850,594, Apr. 11, 1986.

[51] Int. Cl.[4] ..... F02P 1/00

[52] U.S. Cl. ..... 123/606; 123/613; 123/643

[58] Field of Search ..... 123/606, 607, 613, 643

[56] References Cited

U.S. PATENT DOCUMENTS

| | | | |
|---|---|---|---|
| 3,945,362 | 3/1976 | Neuman | 123/606 |
| 3,976,044 | 8/1976 | Madeira | 123/613 |
| 4,181,112 | 1/1980 | Grather | 123/606 |
| 4,245,594 | 1/1981 | Morino | 123/606 |
| 4,359,998 | 11/1982 | Topic | 123/606 |

*Primary Examiner*—Ronald B. Cox
*Attorney, Agent, or Firm*—James H. Phillips

[57] ABSTRACT

A digital ignition system is disclosed including a precision angular position sensor within the engine distributor or in cooperation with another rotary engine part providing accurate timing information applied to gating means selectively passing bursts of triggering pulses having a 7-to-1 duty cycle ratio. The bursts are applied to a driver circuit providing power amplification energizing the coil primary. An alternative mode is also disclosed simulating a conventional make and break ignition system for a service mode. In the service mode, a single pulse is issued to the coil upon the first pulse of the pulse burst after the angular position sensor senses that a cylinder firing operation is required. Thus, ordinary timing and diagnostic instruments may be used during the service mode to accurately establish ignition timing during normal, burst mode operation. A distributorless embodiment is also disclosed in which individual cylinder timing is obtained from individual disk tracks carrying a plurality of circular tracks between individual light sources and sensors. Each cylinder has its own high voltage system, the triggering pulses being directed selectively thereto by gates controlled by timing information from the disk angular position. A plurality of disks may be used for a more rigid and reliable structure.

5 Claims, 16 Drawing Figures

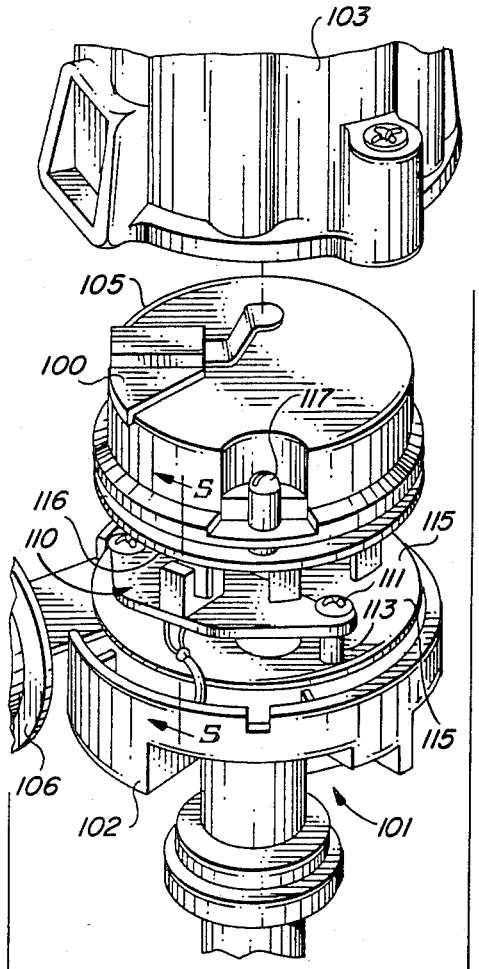
FIG. 3
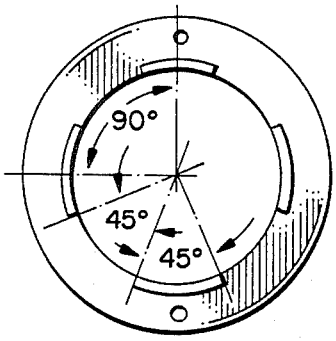
FIG. 6
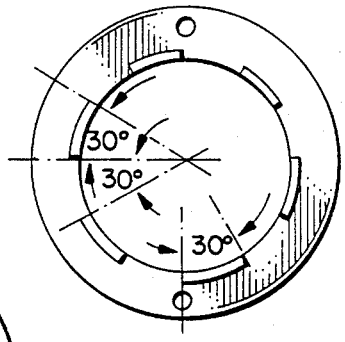
FIG. 7
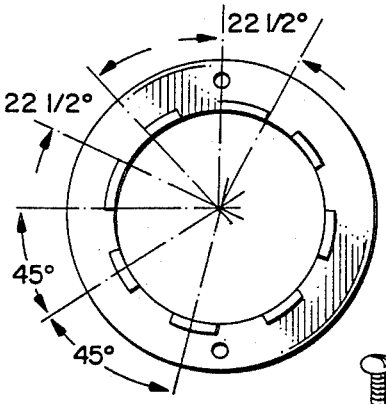
FIG. 8
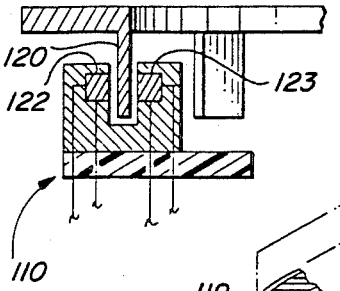
FIG. 5
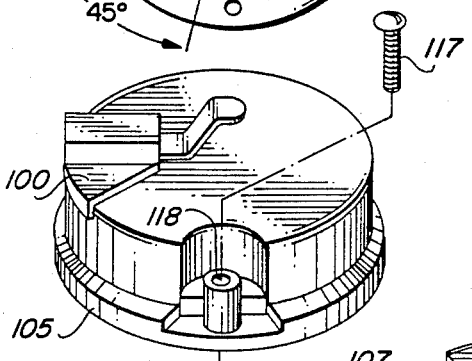
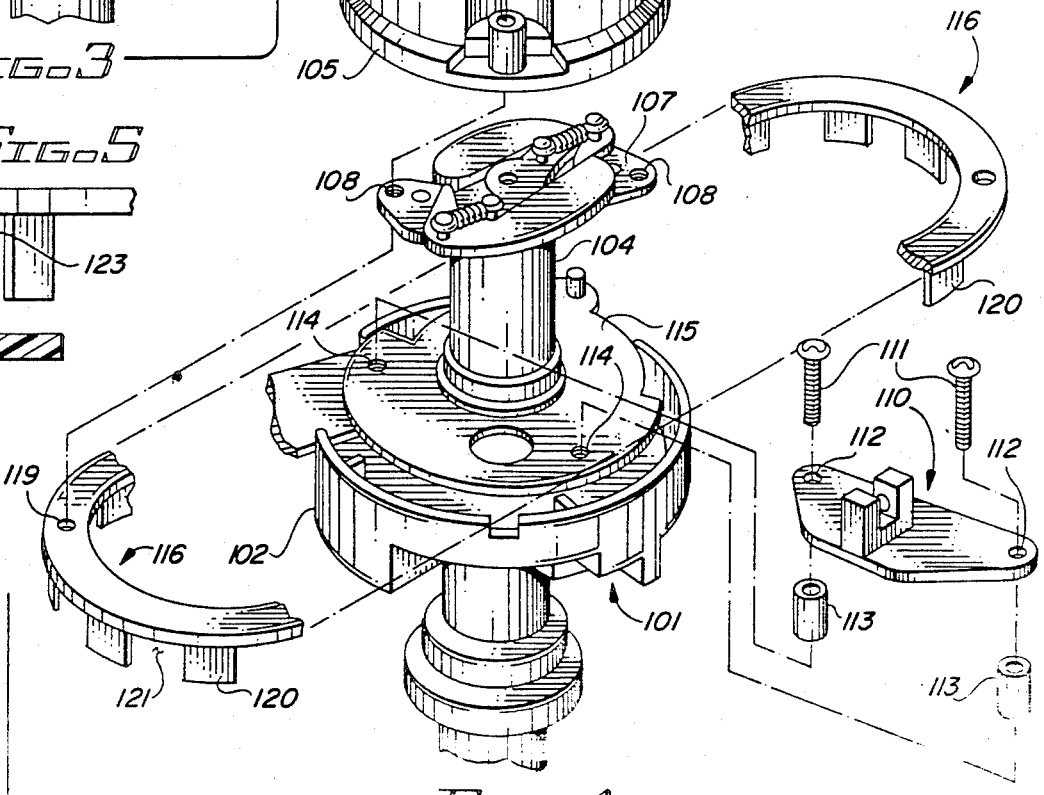
FIG. 4

HIGH PERFORMANCE DISTRIBUTORLESS DIGITAL IGNITION SYSTEM FOR INTERNAL COMBUSTION ENGINES

CROSSREFERENCE TO RELATED APPLICATION

This application is a continuation-in-part of U.S. patent application Ser. No. 850,594, filed Apr. 11, 1986, now pending, for HIGH PERFORMANCE DIGITAL IGNITION SYSTEM FOR INTERNAL COMBUSTION ENGINES, by Craig R. Brown and assigned to the same assignee as the present application.

FIELD OF THE INVENTION

This invention relates to the internal combustion engine arts and, more particularly, to the field of spark ignition systems for such engines.

BACKGROUND OF THE INVENTION

Traditionally, internal combustion engine ignition systems have used either a magneto or, more commonly, a distributor/ignition coil system for developing and distributing, on a timely basis, high voltage electrical energy to the spark plugs which serve to ignite a fuel mixture charge in each cylinder at or near the beginning of a cylinder power stroke. In the past, most distributor/coil ignition systems have employed mechanical points whose contacts are broken periodically in order to permit the collapse of the magnetic field in the ignition coil primary winding to generate, at the nominally correct instant, the high voltage potential in the ignition coil secondary. Distribution of the high voltage potential has been conventionally performed by a rotor in the distributor housing which rotates to sequentially address peripherally distributed electrodes in a distribustor cap which are, in turn, connected to the individual spark plug wires. More recently, diverse systems have been developed to eliminate the breaker points and substitute therefore an electromagnetic or electro-optical sensor assembly connected to a low level amplifier to effect an electronic switch.

As a result of a sense of conversation caused by the notorious energy crisis which developed in the early 1970's in conjunction with heightened sensibilities to the deleterious effects of environmental pollutants issued by internal combustion engine powered vehicles, significant efforts have been directed in recent years to both improving the efficiency of vehicle internal combustion engines and controlling the issuance of pollutants from them. Attention has been given to more closely controlling the instantaneous fuel-to-air mixture, to treatment of the exhaust gas (as by the use of catalytic converters) and to more closely controlling the instant of spark plug firing according to sensed instantaneous engine speed and load conditions. However, one difficulty which remains as a source of both engine inefficiency and the discharge of pollutants is the incomplete combustion which results from the fact that conventional ignition systems cause the spark plugs to arc for only a very brief period during the combustion process in a given cylinder, principally to simply initiate the combustion process.

As previously mentioned, great care is taken to insure that the precise instant at which spark plug arcing begins is optimum for the given conditions present, although truly optimal timing is rarely achieved. However, it has been recognized that, if the spark plug for a given cylinder can be made to continue arcing throughout (or even beyond) the power stroke of the cylinder, much more complete combustion results with a consequent reduction in air pollution, increase in engine power and increase in fuel mileage and which also permits the elimination of some or all of such devices as the E.G.R. valve, A.I.R. pump, temperature delayed spark, ultralean fuel mixture carburetors, catalytic converters and the like.

One prior art system in which the advantages of maintaining the spark plug arc throughout the power stroke of a cylinder was recognized is disclosed in U.S. Pat. No. 4,417,563 to Brodie. Brodie discloses a nearly completely electronic spark development system including a high frequency oscillator, a step up transformer and a voltage multiplier to obtain the requisite high voltage without an ignition coil. Brodie's high voltage, because of its manner of development, is a-c and is maintained continuously. Only the position of the rotor as it sweeps across the peripherally distributed electrodes of the distributor cap serves to effect the timing, the high voltage itself being present continuously.

While Brodie has achieved a valuable contribution to the art, there are nonetheless drawbacks to his system in some internal combustion environments. With respect to retrofitting existing internal combustion engines, Brodie dispenses with the ignition coil which, as previously mentioned, is not required in his system. However, the replacement cost is substantial. Therefore, it will be appreciated by those skilled in the art that it would be useful to provide a more readily retrofitted system which incorporates the existing coil of an internal combustion engine, but which nonetheless enjoys the technical advantage of maintaining the spark plug arc throughout the power stroke of a cylinder. Achieving accurate and reliable timing with Brodie's system is somewhat uncertain because of his reliance on the mechanical position of the rotor to determine when the high voltage will be sent to a given electrode connected to a given spark plug rather than by precisely monitoring the angular position of the distributor shaft. Thus, those skilled in the art will appreciate that it would be highly desirable to provide a system which, like Brodie's system, affords spark plug arcing throughout a cylinder's power stroke, but in which the onset of the arcing is carefully controlled, and which can be readily incorporated into existing or new internal combustion engines.

Those skilled in the art will also appreciate that a trend exists in the automotive industry toward distributorless systems in which each cylinder of a multicylinder engine is provided with an individual high voltage generation subsystem for providing the spark to the plug (or plugs) used for the individual cylinder. Numerous advantages exist to such an arrangement. For example, the arc space within the distributor (from the rotor to the stationary electrode) is eliminated along with the rotating contact to the rotor. In addition, the voltage loss along the ignition wire runs is eliminated along with the EMI/RFI noise generated by these runs. Consequently, there exists a need for incorporating, into a distributorless system, an advanced digital ignition system capable of maintaining an arc of multiple pulses across the spark plug terminals for an extended period up to the theoretical limits of burn throughout (and even beyond) the power stroke of a cylinder The present invention is directed to such ends.

OBJECTS OF THE INVENTION

It is therefore a broad object of my invention to provide an improved ignition system for an internal combustion engine.

It is another object of my invention to provide an ignition system for an internal combustion engine which provides an essentially continuous delivery of high voltage bursts to the spark plug of a cylinder during its power stroke.

It is yet another object of my invention to provide such an ignition system which is economical to fabricate, reliable in long term operation and which can be readily incorporated into existing or new internal combustion engines.

In another aspect, it is an object of my invention to provide such an ignition system which is particularly adapted for configuration as a distributorless system.

It is a more particular object of my invention to provide a distributorless ignition system in which an arc of repetitious pulses is maintained across the electrodes of a spark plug for an optimum period up to the theoretical limits of burn throughout (and even beyond) the power stroke of a cylinder.

SUMMARY OF THE INVENTION

Briefly, these and other objects of the invention are achieved by providing a free running square wave oscillator driving a divide-by-eight circuit which issues a pulse string at about 925 hertz (using conventional coils) and having a seven-to-one duty cycle ratio. The pulse string is selectively applied to driver circuits for the spark plugs of individual cylinders of a multi-cylinder internal combustion engine. The driver circuits provide power amplification to energize the primary circuit of ignition coils associated with each cylinder. An angular position sensor coupled to the engine provides individual timing information which is applied to gating means for selectively passing the 925 hertz signal to the individual coil coil drivers. Preferably, the angular sensing means includes a light source array/light sensor array assembly cooperating with a multi-band rotating disk alternately making and breaking the light beams in accordance with the angular position of the engine. Switch means are provided to system to simulate a conventional make and break ignition system to effect a service mode. In the service mode, timing information is developed from a separate band of the disk from those which provide the individual cylinder timing in the normal mode of operation.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 3 is a partially exploded view of a conventional internal combustion engine distributor into which a sensor assembly component of the subject ignition system has been incorporated;

FIG. 4 is a more completely exploded view of the distributor more clearly depicting the sensor assembly and its relationship to the other distributor components;

FIG. 6 illustrates an exemplary shutter assembly for a four cylinder engine employing the version of my ignition system which employs a distributor;

FIG. 7 illustrates a similar exemplary shutter assembly for a six cylinder engine;

FIG. 8 illustrates another similar exemplary shutter assembly for an eight cylinder system;

FIG. 9 is a block/schematic diagram of a presently preferred distributorless embodiment of the subject ignition system, illustrated as incorporated in a four cylinder engine;

DETAILED DESCRIPTION OF THE INVENTION

Figure 1:
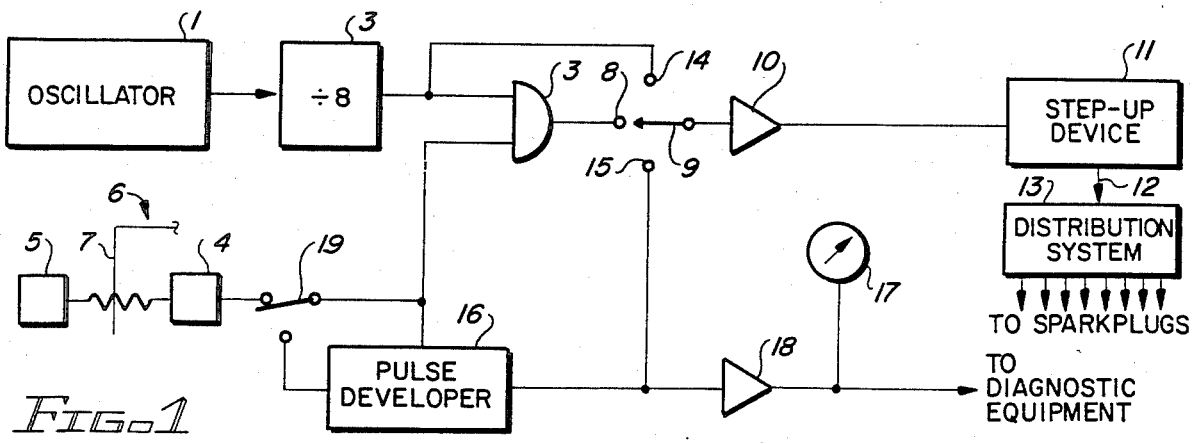
FIG. 1 is a high level functional block diagram of one embodiment of my ignition system.
Figure 2:
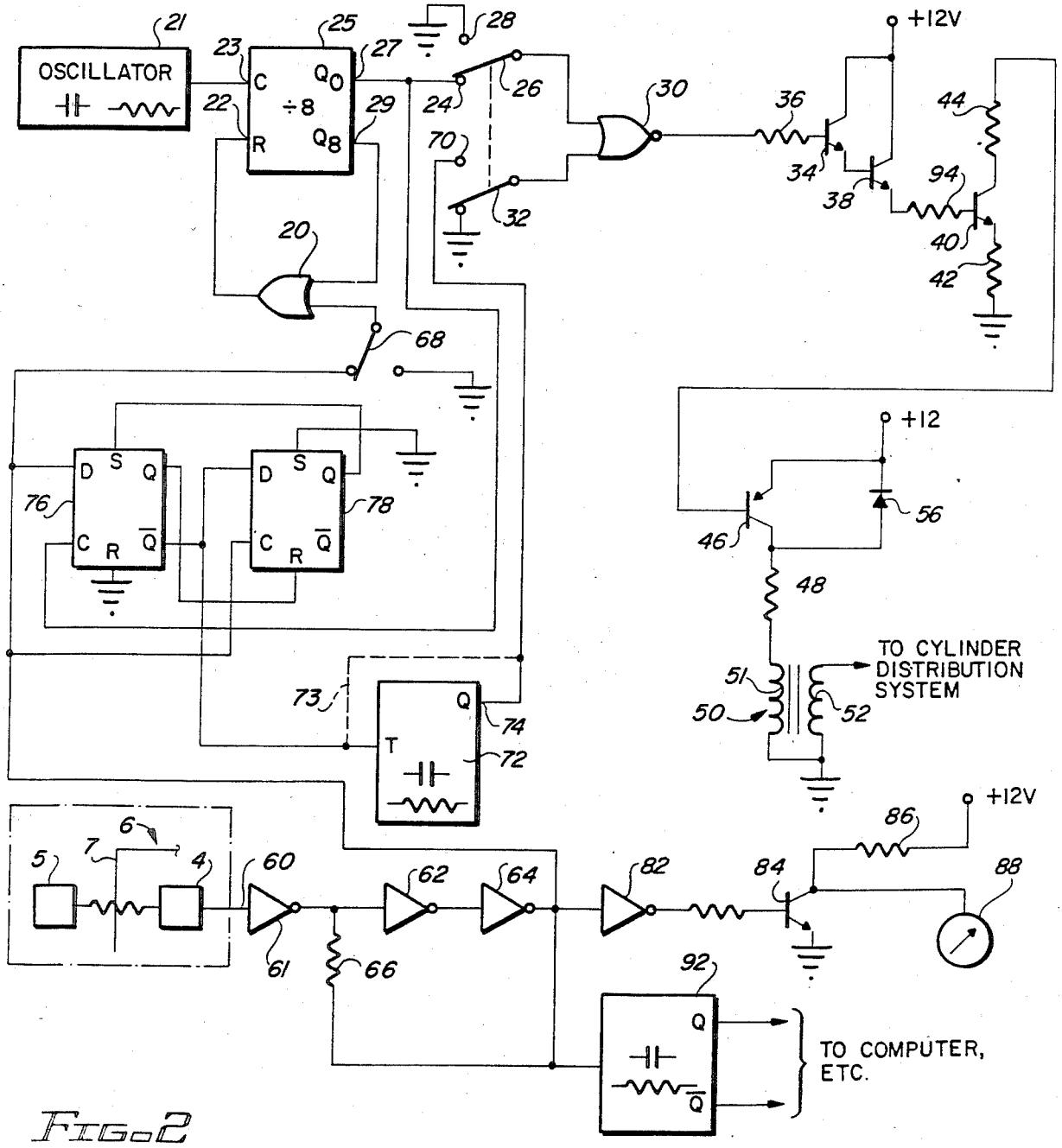
FIG. 2 is a more detailed block/schematic diagram of an embodiment of the subject ignition system employing a distributor.

The basic concepts of the subject ignition system may best be appreciated with initial reference to the simplified representation shown in FIG. 1. A self starting square wave oscillator 1 is configured such that its free running frequency is about 7600 hertz. The output of the oscillator 1 is applied to the input to a divide-by-eight circuit 2. The divide-by-eight circuit 2 is configured to, in effect, pass every eighth pulse issued by the square wave oscillator 1; hence, it will be appreciated that the output of the divide-by-eight circuit 2 has a logic "0" (or "low") to logic "1" (or "high") duty cycle of seven-to-one and constitutes a continuous stream of such pulses. The output of the divide-by-eight circuit 2 is applied as one input to an AND-gate 3 which, as will become more apparent from the description of the presently preferred embodiment shown in FIG. 2, is merely representative of the circuit function. The other input to AND-gate 3 receives timely enabling pulses from the output of a light sensor 4 which correspondingly intermittently receives light from a light source 5 according to the position of a shutter 6. Light sensor 4, light source 5 and shutter 6 are disposed within a conventional internal combustion engine distributor and serve a function similar to conventional points in that, as will be described more fully below, they cooperate to precisely establish the onset of groups of pulses periodically issued to the engine spark plugs. Shutter 6 has a lip 7 which alternatively passes and blocks off the light path between the source 5 and the sensor 4 as the distributor shaft rotates. A more complete description of this assembly is set forth below.

Thus, as intermittent pulses are issued by the light sensor 4, the AND-gate 3 is selectively enabled to pass the pulse stream output from the divide-by-eight circuit 2 to a normally closed terminal 8 of a switch 9. As a result, bursts of the pulses issued by the divide-by-eight circuit 2 are applied to the input of a power amplifier 10 which drives a step up device 11. The step up device 11, in the presently preferred embodiment of the invention, is simply a conventional ignition coil having low voltage primary and high voltage secondary windings.

As previously mentioned, the pulses applied to the amplifier 10 are such as to provide seven units of time "high" followed by one unit of time "low" at the output of the power amplifier 10. Thus, the step-up device 11 has current passing through its primary winding for $\frac{7}{8}$ of each firing cycle to develop full saturation before the current is cut off for the eighth unit of time in order to permit the magnetic field to collapse and issue a high voltage pulse from the secondary winding at the high voltage output line 12. The high voltage pulses appearing at the output line 12 are distributed to the engine spark plugs by a distribution system 13 which may simply be the conventional rotor and cap also being rotated within the engine distributor by the distributor shaft. Alternatively, the distribution system 13 may constitute an electronic distribution system to eliminate the need for a conventional distributor, the timing, in that event, being obtained from a system similar to the distributor timing system, but in some other manner related to instantaneous engine position.

In the event that it is desired to obtain a continuous stream of high voltage pulses at the 925 hertz rate and rely upon the distribution system 13 to effect the timing in a manner similar to that disclosed by the previously mentioned Brodie reference, the switch 9 may be thrown to its first alternative position at the normally open terminal 14. When the switch 9 is in this position, the AND-gate 3 is simply bypassed to provide the continuous stream of asymmetrical duty cycle pulses to the power amplifier 10.

Some ignition timing devices and other diagnostic and alignment equipment currently available are not capable of following the pulse bursts which are characteristic of the subject ignition system in its normal operation mode. In order to permit the use of such devices to precisely establish and set the engine timing and to perform other diagnostic and alignment tasks, the facility for switching to a service mode of operation is provided. In the service mode of operation (in which it is desired to operate essentially as a conventional ignition system so that conventional timing methods, such as timing lights, scopes, etc. can be used), the switch 9 is thrown to its second alternative position to connect the input of the amplifier 10 to normally open terminal 15, and the switch 19 is thrown to its alternative position in which the timing pulse output from the light sensors 4 is redirected to a pulse developer circuit 16. Pulse developer circuit 16 serves to develop a single "low" pulse of the correct timing and length from each pulse issued by the light sensor 4, the output from pulse developer circuit remaining "high" between successive "low" pulses. This "low" pulse, which in effect corresponds to the breaking points in a conventional make and break ignition system and also accurately represents the start of the normal mode (gated bursts) operation, is applied to the power amplifier 10 which abruptly stops the drive to the step up device 11 as previously described. The pulse from the pulse developer 16 may also be employed to drive an isolation amplifier 18 to which a conventional tachometer 17 and other diagnostic and alignment equipment may be connected.

Referring now to the more detailed schematic block diagram shown in FIG. 2, a self-starting square wave oscillator 21 (e.g., a Motorola MC14007) is provided with suitable timing components to obtain a free running frequency of about 7600 hertz. The square wave output of the oscillator 21 is applied to an input 23 of a digital frequency divider 25 having several outputs, among them $Q_0$ output 27 and $Q_8$ output 29. The digital frequency divider 25, which essentially serves to establish the desired ratio between the "high" and "low" states in the pulse stream, may comprise a Motorola MC14017 programmable decade counter which has been programmed to selectively perform the divide-by-eight function by providing a controllable feedback path between its $Q_8$ output and its reset input 22. That is, the $Q_8$ output 29 of frequency divider 25 is applied to a first input of an OR-gate 20 such that, if it is assumed that the second input of OR-gate 20 is at a logic "low" level, a "high" pulse appearing at output 29 will be applied to the "reset" input 22 to prepare the frequency divider 25 to count the next series of eight pulses appearing at its input 23. Thus, complimentary output poles appear at outputs 27 and 29, one for each eight input pulses to provide an output frequency (which is appropriate for conventional ignition coils) of approximately 925 hertz, and the "high" to "low" and "low" to "high" duty cycle ratios at these respective points are seven-to-one.

The $Q_0$ output 27 of frequency divider 25 is applied to a first terminal 24 of a switch 26. The other terminal 28 of switch 26 is connected to ground (i.e., to logic "low"). Terminal 24 of switch 26 is the normally closed position while terminal 28 is normally open and, when closed, enables the service mode previously mentioned and to be described further below. When switch 26 is coupled to terminal 24 for normal operation, the pulse stream at the $Q_0$ output 27 from frequency divider 25 is coupled to a first input of a NOR gate 30, the second input of which is normally grounded (i.e., maintained at logic "low") via switch 32. Thus, the pulse stream is inverted by NOR gate 30, and the resulting signal is applied through an isolation resistor 36 to the base electrode of an NPN transistor 34.

Transistors 34 and 38 (which may be, e.g., type 2N2222) are connected in a Darlington pair configuration (with their collector electrodes connected to +12 volts d-c) to form a high-gain current amplifier, the output of which is coupled to the base electrode of an NPN driver transistor 40 (which may be a type 2N3055).

The driver transistor 40 has its emitter electrode coupled to ground via resistor 42, and its collector electrode is coupled, via isolation resistor 44, to the base electrode of a PNP power switching transistor 46 which may be a Motorola type MJ2955. The collector electrode of power transistor 46 is coupled via a current limiting resistor 48 to the primary winding 51 of an ignition coil 50. The emitter electrode of power transistor 46 is connected to a +12 volt d-c source, and power transistor 46 is shunted by a diode 56 to protect the transistor from back E.M.F. which occurs when the current flowing through the coil primary 51 is abruptly interrupted. As those skilled in the art will understand, during each period when power transistor 46 is conducting, current passes through the coil primary 51, and a magnetic field builds up. When the power transistor 46 is switched off to interrupt the current flow, the magnetic field suddenly collapses to induce a high voltage pulse into the secondary winding 52 of the coil 50, and the high voltage pulse is communicated to a spark plug by the high voltage distribution system.

A light sensor 4 and a light source 5 are employed to obtain fundamental ignition timing information in accordance with the angular position of the engine as it rotates and are situated in a position indicating device such as a distributor. When the light sensor 5 receives light from the source 4 (which occurs when a segmented shutter 6 does not present a lip segment across the light path), a "low" signal is generated by the sensor 4 whose output 60 is coupled to and amplified by a low level amplifier 61 which drives a Schmitt-trigger comprising series coupled inverters 62 and 64. In the conventional fashion, a resistor 66 is cross coupled between the input to inverter 62 and the output of inverter 64 providing a certain amount of hysteresis which improves rise and fall times. Inverters 62 and 64 may comprise a pair of sections of a Motorola MC14007. Thus, when the sensor output 60 is switching, much faster and cleaner transitions between "low" and "high" appear at the output of inverter 64. This signal is applied to the second input of OR-gate 20, and, as a result, during periods in which the output of inverter 64 is "low", the pulses appearing at the $Q_8$ output 29 of divider 25 pass through OR-gate 20 to the reset input 22, thus permitting the divider 25 to continuously divide the incoming signal by eight as previously described. However, grounding a second input of OR-gate 20 by actuating switch 68 will cause divider 25 to completely ignore the output of the light sensor 4 and run free at all times. The function of switch 68 will be discussed further below.

When a lip segment 7 of the segmented shutter 6 blocks the light path between light source 5 and light sensor 4, a "high" output will appear at the sensor output 60 and therefore also at the output of inverter 64, thus disabling OR-gate 20 and stopping the pulse streams from issuing from the outputs 27, 29 of frequency divider 25. It will therefore be understood that as long as the output of light sensor 4 is "low", a stream of pulses is applied to the ignition coil 50, and the coil is energized for seven/eighths of the period between individual cutoff pulse transitions (and also between each group of pulses) to permit building maximum flux in the primary winding 51, thereby assuring an accurately timed spark at the instant each individual cutoff transition occurs. When the output of light sensor 4 goes "high", as during the period after the completion of a power stroke in one cylinder and before the beginning of the power stroke of the next cylinder to fire, no pulses are applied to the ignition coil 50 which therefore prevents the premature onset of ignition of the next cylinder in the firing order.

As previously mentioned, provision is made for operation in a service mode in which single pulse "breaker point" operation is emulated. In the service mode, switches 26 and 32 are thrown to their alternate position such that switch 26 is coupled to terminal 28 and switch 32 is coupled to terminal 70. Switches 26 and 32 may be ganged as shown in FIG. 2 for convenience.

In the service mode configuration, a programmable monostable flipflop 72 (which may be a Motorola type MC14528) may optionally be utilized to generate a firing pulse of predetermined width (by selecting appropriate RC components) at its Q output 74 in response to a sensed transition from "high" to "low" by the light sensor 4. The firing pulse is applied via terminal 70 of switch 32 to NOR-gate 30 and thence to the remainder of the circuitry beyond NOR-gate 30 as previously described. If a firing pulse of precise width is not desired in the service mode of operation, the flipflop 72 may be eliminated as indicated by the dashed line 73.

Whether or not the optional flipflop 72 is present, the single pulse is developed as follows. The $Q_0$ output 27 of the frequency divider 25 is applied to the clock input of a first D-type flipflop 76. The D input of flipflop 76 and the clock input of a second D-type flipflop 78 are coupled to receive the output of inverter 64. The Q output of flipflop 76 is coupled to the reset input of flipflop 78, and the reset input of flipflop 76 and the set input to flipflop 78 are grounded to hold them at logic "low". (The D-type flipflops 76 and 78 may be Motorola type MC14013 or equivalent.) The Q bar output of flipflop 76 is coupled to the D input of flipflop 78 and also to the trigger input of monostable flipflop 72 if provided or is connected directly to the terminal 70 of switch 32 if the flipflop 72 is eliminated. The Q output of flipflop 78 is coupled to the set input of flipflop 76.

Consider now the following operation. If it is first assumed that a lip segment 7 of the segmented shutter 6 blocks the light path between light source 5 and light sensor 4 and that flipflop 76 is set (as it must be by the second cycle of operation) then the output 60 of light sensor 4 is "low" (a characteristic of the selected device which may be a Texas Instruments TIL-145), and the output of inverter amplifier 61 is "high". Therefore, the output of inverter 64 is also high, OR-gate 20 is disabled, the $Q_0$ output 27 of frequency divider 25 is low, the Q output of flipflop 76 is "high" (i.e., flipflop 76 holds a logic "1"), and flipflop 78 is reset.

Thus, flipflops 76 and 78 remain in this set state, until OR-gate 20 is again enabled by the next "high"-to-"low" transition at the output of inverter 64 (i.e., "low"-to-"high" transition at the output of light sensor 4) which is applied to the data (D) input of flipflop 76.

The "high"-to-"low" transition of the output of inverter 64 enables the OR-gate 20 to allow the reset input to divider 25 to switch to the active mode, thereby causing divider 25 to issue its pulses at output 27; and the first "low"-to-"high" transition of the $Q_0$ output 27 serves as a valid clock pulse for flipflop 76. The "low"-to-"high" clock pulse allows the transfer of the "low" on the data (D) input to the Q output, and thus the Q bar output issues a "low"-to-"high" transition. This signal is coupled to terminal 70 on switch 32, and the result of this transition is to turn off power amplifier 46, thereby shutting off current flow to primary coil 51, part of coil 50. This causes the spark energy to be produced in the coil secondary 52 when the magnetic field collapses in coil 50.

The Q bar output of flipflop 76 is also coupled to the D input (data) of flipflop 78, but flipflop 78 does not respond to this data at this instant because it has an invalid clock (non-active) state. The Q output of flipflop 76 goes to a "low" state to allow flipflop 78 to respond to the input data as soon as a "low"-to-"high" transition appears at its clock input. When the output of inverter 64 switches to the "high" state, the rising edge is felt by flipflop 78 clock input, and thus it clocks the "high" from the data input (which is connected to the Q bar output of flipflop 76), to its Q output which is, in turn, connected to the set input of flipflop 76 to promptly force flipflop 76 asynchronously to the set state (Q output "high", Q bar output "low"), thereby restoring current to the coil 50 as the power amplifier 46 is restored to the active current passing condition. Additionally the "low" at Q bar is felt at the D input to flipflop 78, and the "high" level of Q output of flipflop 76 will be felt by the reset input of flipflop 78, thus resetting it for the next pulse.

The state of flipflop 78 remains reset because, even though the Q bar output of flipflop 76 goes "low" causing the D input of flipflop 78 to go "low", the clock input of flipflop 78 remains "high" (i.e., the inactive state). Also, the data to the D input of flipflop 76 remains at a "high" level. Therefore there is no change at the output of flipflop 78 because there is no "low"-to-"high" transition. However, when the output of inverter 64 (the inverted output of light sensor 4) next goes "high", flipflop 78 is clocked causing its Q output to go "high" which sets flipflop 76.

When the Q bar output of flipflop 76 made its "low"-to-"high" transition, monostable flipflop 72, if provided, was triggered causing an output pulse to appear at its Q output 74. This pulse, the width of which is determined by selecting appropriate timing RC components, is applied to terminal 70 of switch 32 and therefore to and through NOR-gate 30 and to the succeeding circuitry. In this manner, a single pulse emulating the opening of a set of conventional points is obtained for use in the service mode. As previously mentioned, the output pulse from the Q bar output of flipflop 76 may be directly connected to the terminal 70 of switch 32 to obviate the necessity for the flipflop 72. For most applications, the "firing pulse" thus obtained is entirely satisfactory.

The output of inverter 64 is also applied to the input of another inverter 82 which has its output coupled to the base electrode of an NPN transistor 84 (e.g., a 2N2222). Transistor 84 has its emitter electrode connected to ground and its collector electrode coupled to a source of supply voltage (e.g., +12 volts d-c) via resistor 86, and an output 88 may be taken from the collector of transistor 84 to drive, for example, a conventional tachometer 17 or an on-board computer. Optionally, the output of inverter 64 may also be applied to trigger a second monostable flipflop 92 such that a "low"-to-"high" transition at the output of inverter 64 will cause counterpole pulses to be generated at the Q and Q bar outputs of the monostable flipflop 92. These output signals may be used by, for example, a diagnostic or an on-board computer.

It will be understood from the foregoing discussion that the manner in which a single pulse is developed in the service mode corresponds exactly in timing to the onset of a burst of pulses in the normal operating mode. Therefore, very precise ignition timing can be established in the service mode.

If it is desired to continuously apply firing pules to the ignition coil 50 without regard to the angular position of the shutter 6, and thus emulate the Brodie system, the switch 68 may be thrown to its alternate position which leaves OR-gate 20 permanently enabled whereby frequency divider 25 continues to count without the periodic interruptions controlled by the light sensor 4. If this feature is not deemed desirable, switch 68 may simply be omitted.

As previously mentioned, a feature of this invention is the fact that it can be readily integrated into existing internal combustion engine ignition systems as well as into new systems with or without a conventional distributor. FIGS. 3 and 4 illustrate the manner in which a light source/sensor assembly 110 may be incorporated into an existing internal combustion engine distributor to facilitate retrofitting the subject digital ignition system. Thus, a conventional distributor 101 includes a base 102 over which is fitted a cap 103 to enclose the rotating structure. A distributor shaft 104 extends downwardly into the engine and is geared to the engine to obtain and transmit instantaneous engine angular position information in the well known manner. A rotor 105 turns with the shaft 104 to distribute high tension energy to a series of circumferentially distributed electrodes within the cap 103, again in the well known manner, for distribution to the several engine spark plugs via spark plug wires (not shown) inserted into the top of distributor cap 103. Engine timing may be dynamically altered according to the response of vacuum advance unit 106 and centrifugal weights 107, again in the conventional and well known fashion. The electrode 100 carried by the rotor 105 may advantageously be "pie" shaped as shown to limit the resistance voltage drop across its length.

The distributor 101 does not employ breaker points to establish the instant at which a spark plug is energized but rather has been fitted, or retrofitted, with the light source/sensor assembly 110 which is the preferred firing coordination sensor for the present invention. More particularly, and also referring to FIG. 5, the light source/sensor assembly 110 is situated in the position normally occupied by a set of breaker points and is secured by screws 111 passing through apertures 112 and spacers 113 and turned into threaded apertures 114 provided in the distributor slide plate 115.

A circular shutter assembly 116 is positioned below the rotor 105 and the centrifugal weight structure 107, and these components rotate together with the distributor shaft 104. The circular shutter assembly 116 is secured in position beneath the centrifugal weight structure 107 by screws exemplified by the screw 117 passing through an aperture 118 through the outer edge of the rotor 105, through an aperture 108 in the centrifugal weight structure 107 and into a threaded hole 119 in the shutter assembly 116. One or more additional screws, not shown, are distributed around the rotor 105 to rigidly juxtapose the shutter assembly 116 to the underside of the centrifugal weight structure 107.

Figure 5:
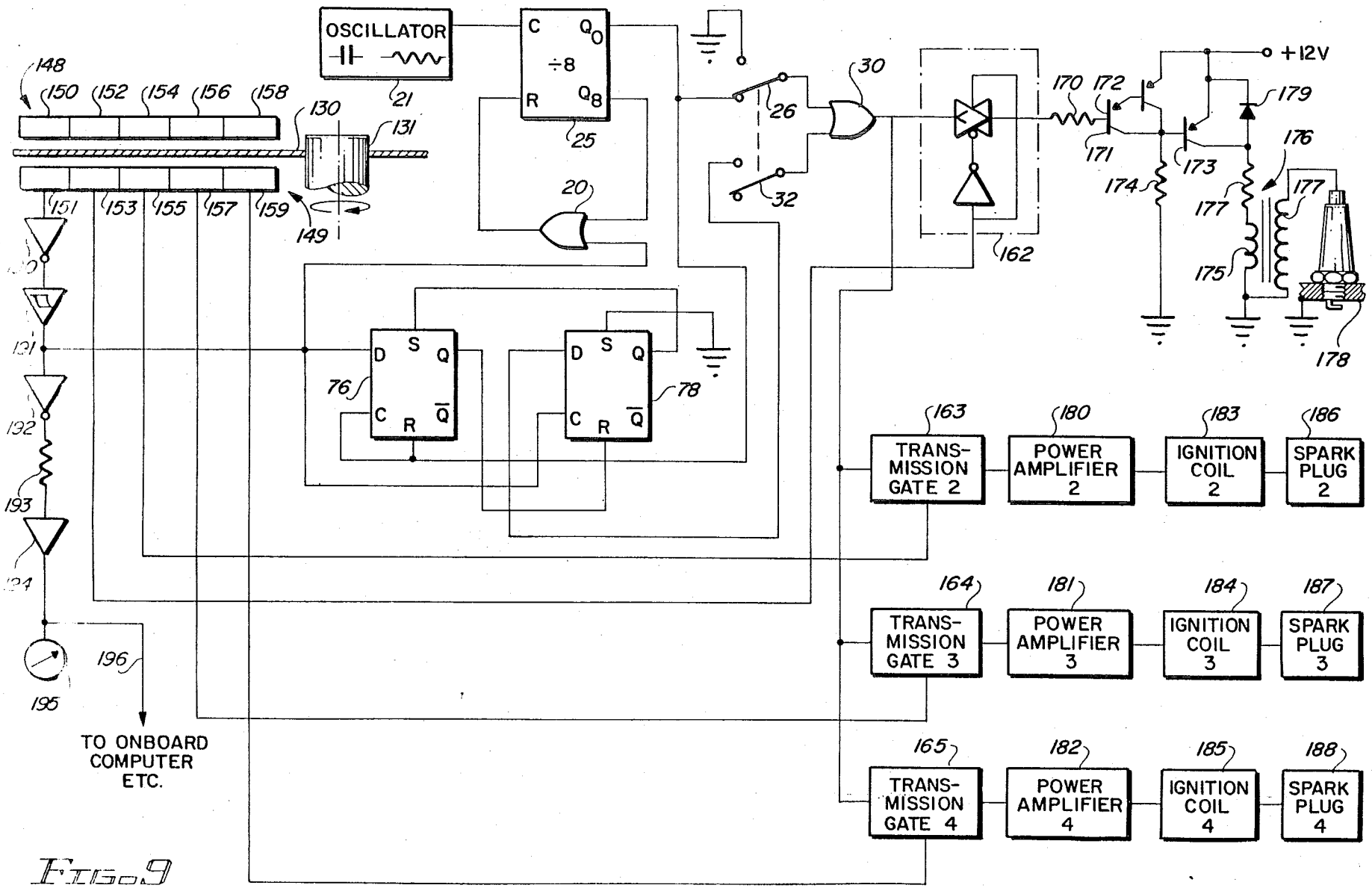
FIG. 5 is a partial cross sectional view taken along the lines 5—5 of FIG. 3 to particularly illustrate the manner in which timing signals are obtained in the ignition system version employing a distributor to coordinate the operation thereof by the cooperation of the sensor assembly and a rotating shutter assembly.

As best shown in FIGS. 4 and 5, the shutter assembly 116 includes downwardly extending lip segments 120 separated by spaces 121 disposed proximate the outer periphery of the shutter assembly. Referring specifically to FIG. 5, it will be seen that the light source/sensor assembly 110 includes light source 122, which corresponds to the light source 5 illustrated in FIGS. 1 and 2, and light sensor 123 which corresponds to the light sensor 4 illustrated in FIGS. 1 and 2. The mutual orientation of the light source/sensor assembly 110 and the shutter assembly 116 are such that the lip segments 120 extend downwardly into the space between the light source 122 and the light sensor 123 to cut off light communication therebetween. Thus, it will be understood that as successive lip segments 120 and spaces 121 alternately pass through this region, the light is correspondingly alternately passed and stopped to create a pulsating signal which is employed as the basic timing source in the ignition system as previously described during the discussion of FIGS. 1 and 2.

To those skilled in the art, it will be immediately apparent that the light source/light sensor method of extracting angular timing information is much more stable and precise than such other commonly used methods as reluctance coil (Hall effect) and magnet pole pieces, and points as well as the magneto type of ignition systems. The fundamental reason for this advantage is that the light source/light sensor is accurate at any speed from 0 RPM to the "red-line" speed of any given engine.

FIGS. 6, 7 and 8 are views from below of shutter assemblies 116*a*, 116*b*, and 116*c* which are, respectively, particularly adapted for 4, 6 and 8 cylinder engines. As shown in FIG. 6, four lip segments 120*a* are separated by four spaces 121*a*, and each lip and space occupies an angular forty-five degrees. Similarly, in FIG. 116*b* there are six lip segments 120*b* and six spaces 121*b*, each occupying a thirty degree segment. Finally, as shown in FIG. 8, each of eight lip segments 120*c* and eight spaces 121*c* occupy twenty-two and a half degrees arc. It will be appreciated from an examination of FIGS. 6, 7 and 8 that the pulses sensed by the light sensor 123 (i.e., the light sensor 4 in FIGS. 1 and 2) as a space 121 passes through the gap between the light source 122 and 123 results in gating the firing pulse stream to the ignition coil primary to provide continuous even sparking throughout essentially the complete power stroke of a given cylinder. That is, if the ignition timing is set to top dead center, the spark plugs fires continually throughout the entire power downstroke of the piston in the cylinder, and if the initial timing is adjusted a little before or after top dead center, the spark plug correspondingly continues to fire until just a little before or after bottom dead center.

It will be appreciated that the lip segments 120 and the space segments 121 need not occupy equal angles. If desired, the angular scope of the lip segments may be increased or decreased in order to fire each spark plug for more or less than the full power stroke of a cylinder.

The foregoing system is especially applicable to incorporation into combustion engine ignition systems employing more or less conventional distributors and in which a single ignition coil is employed. Those skilled in the art will appreciate that a trend in the industry exists toward the incorporation of individual high voltage spark producing apparatus for each spark plug of a multi-cylinder internal combustion engine. FIG. 9 illustrates an embodiment of the invention particularly adapted for incorporation into such "distributorless" systems. In the system illustrated in FIG. 9, the oscillator 21, digital frequency divider 25, OR-gate 20, switches 26 and 32, NOR-gate 30 and D-type flipflops 76, 78 serve exactly the same functions as the identically numbered components in the system illustrated in FIG. 2 and discussed in detail above. However, the fundamental engine timing information is obtained differently, and individual high voltage development apparatus is provided for each cylinder. The exemplary system shown in FIG. 9 is adapted for use with a four cylinder engine; however, corresponding systems adapted for use with engines having different numbers of cylinders are contemplated and will be discussed further below.

Figure 12:
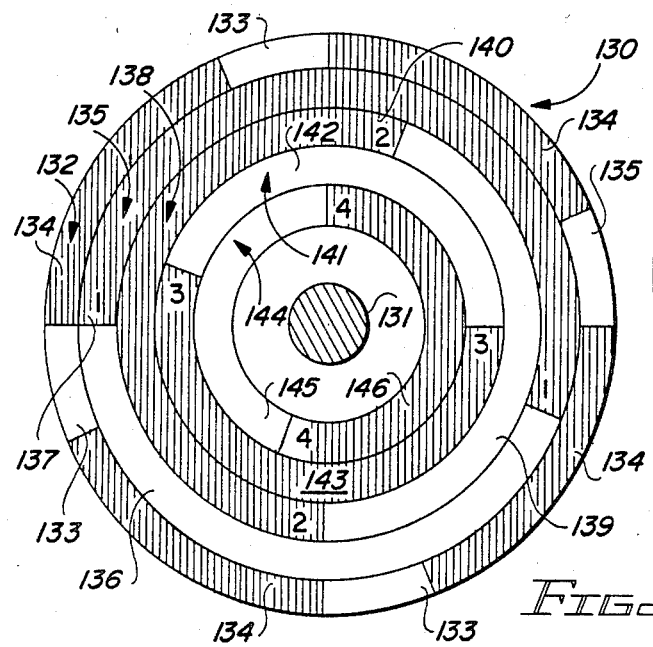
FIG. 12 is a plan view of a timing disk for use in an four cylinder version of the distributorless embodiment illustrated in FIG. 9.

A disk 130 (see also FIG. 12) is carried by a shaft 131 which extends downwardly into the engine and is geared to the engine to obtain and transmit instantaneous engine angular position information in the manner corresponding to the distributor shaft 104 previously described. As best shown in FIG. 12, disk 130 comprises five coaxial circular tracks, each consisting of alternate opaque and clear sectors. More particularly, outermost track 132 includes four clear sectors 133 separated by four opaque sectors 134. As will become more readily understood from the following description, the outermost track 132 is employed to obtain timing information in the service mode of operation and also is the source of timing pulses for tachometers, onboard computers, and the like.

The second track 135 from the outside consists of one clear sector 136 and one opaque sector 137. For the specific configuration exemplified by disk 130, the clear sector 136 extends circumferentially for approximately 160 degrees with the opaque sector 137 making up the remainder of the circumference of the track 135.

Similarly, the next track 138 consists of one clear sector 139 of about 160 degrees and one opaque sector 140; and the next track 141 consists of clear sector 142 of about 160 degrees and opaque sector 143. Finally, innermost track 144 consists of one clear sector 145 and one opaque sector 146.

It will be noted that each clear sector 136, 139, 142, 145 commences at a circumferential position identical to the commencement of one of the four 90 degree spaced clear sectors 133 provided in the outermost track 132. As will become more apparent below, the track 135 provides the timing for the first cylinder to fire in the firing order, the track 138 for the second cylinder to fire, the track 141 for the third cylinder to fire and the track 144 for the last cylinder to fire in the four cylinder engine. Since the outermost track 132 provides service mode timing, it is essential that the leading edges of its clear sectors be in radial alignment with the leading edges of the clear sectors in the individual cylinder tracks as described above.

Referring again to FIG. 9, it will be observed that the disk 130 extends between radially extending and mutually aligned light source array 148 and light sensor array 149. Thus, a first individual light source 150 in the array 148 issues light which is selectively communicated to a first individual light sensor 151 in array 149 according to the angular position of the disk 138 and the portion of the track 132 immediately interposed between the source 150 and sensor 151. Similar relationships exist between source 152, sensor 153 and track 135; source 154, sensor 155 and track 138; source 156, sensor 157 and track 141; and source 158, sensor 159 and track 144. Those skilled in the art will appreciate that light source array 148 could alternatively consist of a single linear light source if care is taken to correctly direct the requisite illumination to each of the light sensors.

In the normal operating mode in which the switches 26 and 32 are in the position shown in FIG. 9, the output from NOR-gate 30 is applied in parallel to a first transmission gate 162, a second transmission gate 163, a third transmission gate 164 and a fourth transmission gate 165. Transmission gates 162, 163, 164, 165 may be Motorola type MC14016B, a device which is characterized by the provision of four independent bidirectional switches, each capable of controlling either digital or analog sigals. The transmission gates have very low internal on-resistance and very fast response and therefore transfer the pulses issuing from the NOR-gate 30 better, for the present application, than, for example, conventional AND-gates. However, the substitution of AND-gates with acceptable transmission and control characteristics is contemplated.

A control input to transmission gate 162 is driven by the output from light sensor 153, and it will be understood that when sensor 153 receives light from corresponding light source 152 through clear sector 136 of track 135, transmission gate 162 is switched to the conductive state to pass the pulses appearing at the output of NOR-gate 30. (Those skilled in the art will appreciate, of course, that the several opaque and clear sectors could be reversed—i.e., clear changed to opaque and opaque changed to clear—if the succeeding circuitry is adjusted accordingly.) Similarly, control inputs to the transmission gates 163, 164, 165 are coupled, respectively, to the outputs of light sensors 155, 157, 159 to respond to clear and opaque sectors of tracks 138, 141, 144 as they pass between the sensors and their corresponding light sources 154, 156, 158.

The output from transmission gate 162 is applied, through isolation resistor 170, to the base electrode of a first transistor 171 which has its emitter electrode connected to the base electrode of another transistor 172. Transistors 171 and 172 (which may be, e.g., type 2N2907A) are connected in a Darlington pair configuration with their collector electrodes connected together to form a high gain current amplifier, the output of which is coupled to the base electrode of a PNP power transistor 173. Transistor 173 may be, for example, a Motorola type MJ11015, or a Darlington pair configuration may be employed using, for example, Motorola type MJ2955 transistors. Similarly, the transistors 171, 172 could be replaced by one device, such as Motorola type MPSA63, comprising a Darlington pair in a single package. Those skilled in the art will appreciate that numerous substitute devices can be employed in the driver and power amplifier sections of the circuitry.

The common collector electrodes of the transistors 171, 172 are connected to ground through a power resistor 174 which may be 75 ohms with a power rating of two watts or more. The emitter electrodes of the transistors 172, 173 are connected directly to a +12-volt d-c power source such as the vehicle battery power system.

The power transistor 173 is the switching element in a series circuit disposed between the 12 volt power source and ground. The series circuit includes a primary winding 175 of an ignition coil 176 and a current limiting resistor 177 which may have a value on the order of 0.5–1.35 ohms with a power rating of one hundred watts or more. The secondary winding 177 of ignition coil 176 is connected directly to a spark plug 178 which is therefore fired by the previously characterized pulses originating in the oscillator 21/frequency divider 25 circuitry during the engine cycle angle range in which the clear portion of the track 135 is disposed between the light source 152 and the light sensor 153; i.e., when the transmission gate 162 is rendered conductive. Power transistor 173 is shunted by a diode 179 to protect the transistor from back EMF transients which occur when the current flowing through the coil primary 175 is abruptly interrupted.

In the exemplary four cylinder engine ignition system illustrated in FIG. 9, the driver/power amplifier modules 180, 181, 182 contain circuitry identical to that disposed between the transmission gate 162 and the primary winding 175 of the ignition coil 176. Similarly, ignition coils 183, 184, 185 and spark plugs 186, 187, 188 provide the identical functions for the remaining three cylinders as described for the first cylinder in the firing order. As will be apparent from an examination of the four cylinder disk illustrated in FIG. 12, the cylinders fire in sequence; and the burn, in each case, is maintained through the arc of the clear sectors (approximately 160 degrees for the exemplary disk). By controlling the arc occupied by the clear sectors, the degree of burn may be established at the optimum for a given engine and may be extended as appropriate or desired up to the theoretical limits, this facility constituting an important feature of the invention. Typically, the burn will be maintained throughout the power stroke and into the exhaust stroke of a cylinder.

Still referring to FIGS. 9 and 12, it has been previously noted that the outermost track 132 has four equally circumferentially distributed clear sectors 133 and that the leading edge of each clear sector lines up with the leading edge of a unique one of the clear sectors carried on the tracks 135, 138, 141 and 144. Thus, the clear sectors 133 of the track 132 provide accurate timing information which can be employed for other system uses and also to very accurately set normal mode timing during the service mode of operation. It will be appreciated that this means for sensing engine angular position is so accurate and abrupt as to permit setting the ignition timing precisely using only a volt meter connected at the tachometer drive and without the engine running, a feature also enjoyed by the single coil system illustrated in FIG. 2.

An inverter 190, which has its input connected to receive signals from the sensor 151 associated with the outermost track 132, drives a Schmitt trigger 191. The inverter 190 corresponds to the inverter 61 in the previously described system illustrated in FIG. 2, and the Schmitt trigger 191 corresponds to the combination of the inverters 62, 64 and feedback resistor 66. Therefore, it will be understood that the timing signal issuing from the Schmitt trigger 191 serves to establish the service mode of operation in the distributorless system illustrated in FIG. 9 when the switches 26, 32 (which may be ganged for convenience) are thrown to their alternative service mode positions. In this circuit configuration, as previously noted, the D-type flipflops 76, 78, the OR-gate 20 and the interconnections between the devices serve to establish the service mode of operation in which single pulses issue from the Nor-gate 30 very accurately timed to emulate the timing during the normal mode of operation in which gated bursts are applied to the several ignition coils as previously described. For the distributorless system illustrated in FIG. 9, however, the individual firing of the several cylinders is still determined by the angular position of the leading edges of the clear sectors in the bands 135, 138, 141 and 144.

In addition to providing basic timing for effecting service mode operation, the signals appearing at the output of Schmitt trigger 191 may also be used to drive an inverter 192 which, through isolation resistor 193, drives an amplifier 194 which may simply be a single transistor stage corresponding to the transistor 84 shown in FIG. 2. Thus, whether the system is in the normal or service mode of operation, amplifier 194 provides pulse information to a tachometer 195 and accurate timing information to such additional equipment as onboard computers, etc. via output line 196.

Figure 10:
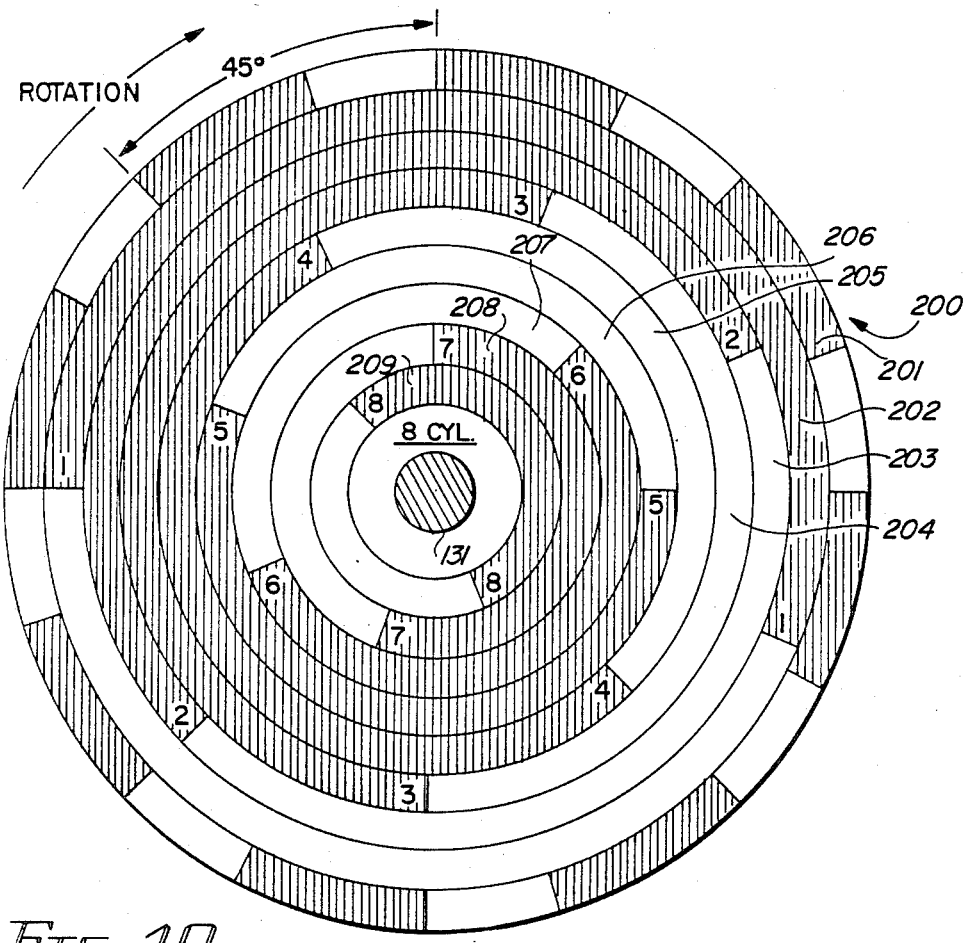
FIG. 10 is a plan view of a timing disk for use in an eight cylinder version of the distributorless embodiment illustrated in FIG. 9.
Figure 11:
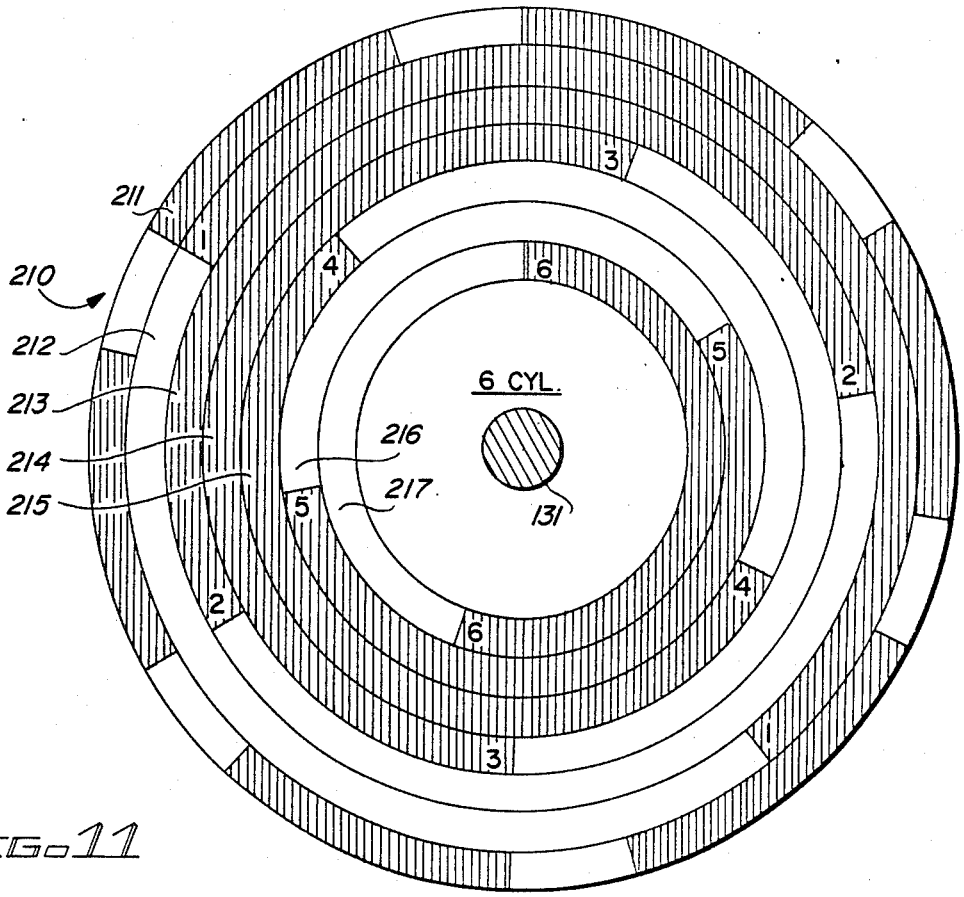
FIG. 11 is a plan view of a timing disk for use in an six cylinder version of the distributorless embodiment illustrated in FIG. 9.

It will be apparent from the foregoing discussion that the system illustrated in FIG. 9 may be readily adapted to an engine of any number of cylinders simply by providing the appropriate disk and light source/light sensor assembly corresponding to the light source array 148 and light source array 149. Thus, FIGS. 10 and 11 illustrate, respectively, disks for eight and six cylinder engines. More particularly, FIG. 10 illustrates a nine band disk 200 which includes an outer band 201 analogous to the timing band 132 of the disk 130 (FIG. 12) and having alternate clear and opaque sectors. Then, for successive cylinders in the firing order, bands 202, 203, 204, 205, 206, 207, 208 and 209 provide the individual timing information for each of the eight cylinders of the engine by the provision of the single clear sectors of approximately 160 degrees and complimentary single opaque sectors effecting the remainder of the circumference of each band.

In FIG. 11, the six cylinder disk 210 has seven bands including the outer band 211 providing the service mode timing information and individual cylinder timing bands 212, 213, 214, 215, 216 and 217, each of the latter comprising a clear sector of approximately 160 degrees arc and a complementary opaque sector completing the band circumference.

Figure 14:
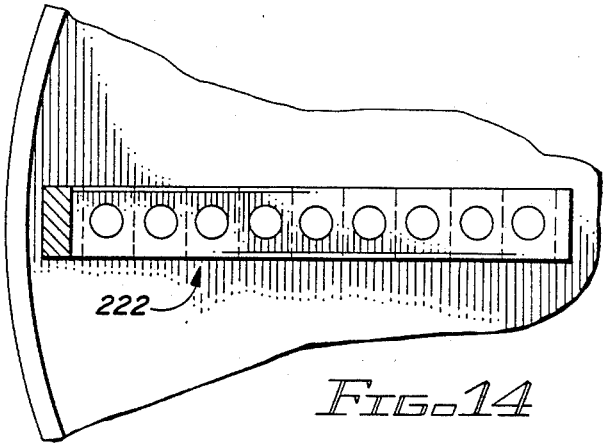
FIG. 14 is a cutaway view of the region identified along the lines 14—14 of FIG. 13.
Figure 13:
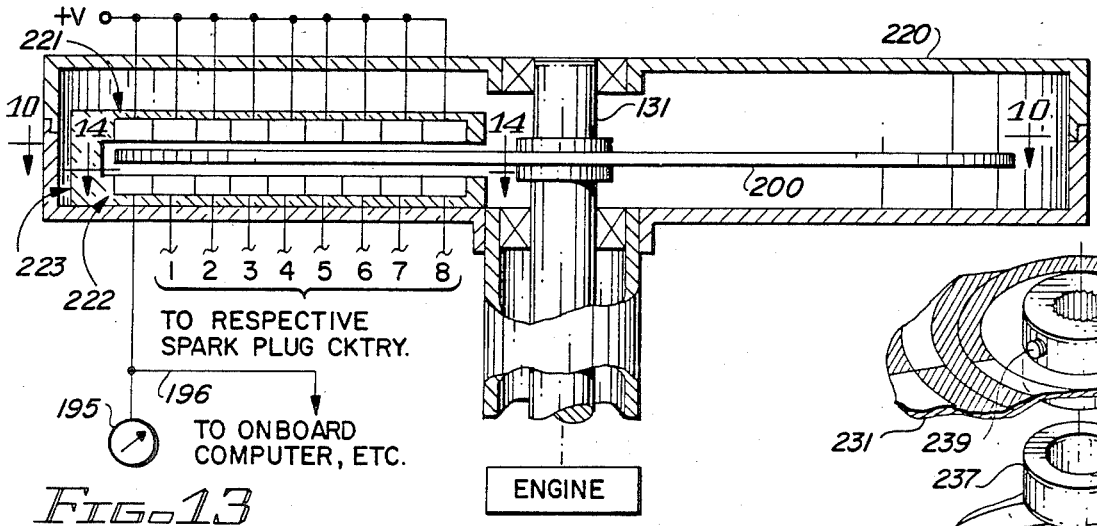
FIG. 13 is a cross sectional view illustrating an exemplary subsystem for obtaining timing information for the distributorless system of FIG. 9 and particularly showing the cooperative relationship between a timing disk and light source and light sensor arrays.

Attention is now directed to FIG. 13 which illustrates the eight cylinder, nine track disk 200 carried by a shaft 139 in a housing 220. Light source array 221 (see also FIG. 14) comprises nine radially distributed individual light sources. Similarly, light sensor array 222 comprises nine radially distributed individual light sensors. The arrays 221, 222 are preferably rigidly supported in face to face alignment as a C-shaped assembly 223. Eight of the sensors in the array 222 provide timing information to the drive circuitry for the spark plugs of the corresponding cylinders. The outer most sensor of the array 222, as discussed in conjunction with the four cylinder version illustrated in FIG. 9, drives a tachometer 195 and other onboard instrumentation through output lead 196 as well as providing service mode timing.

Figure 15:
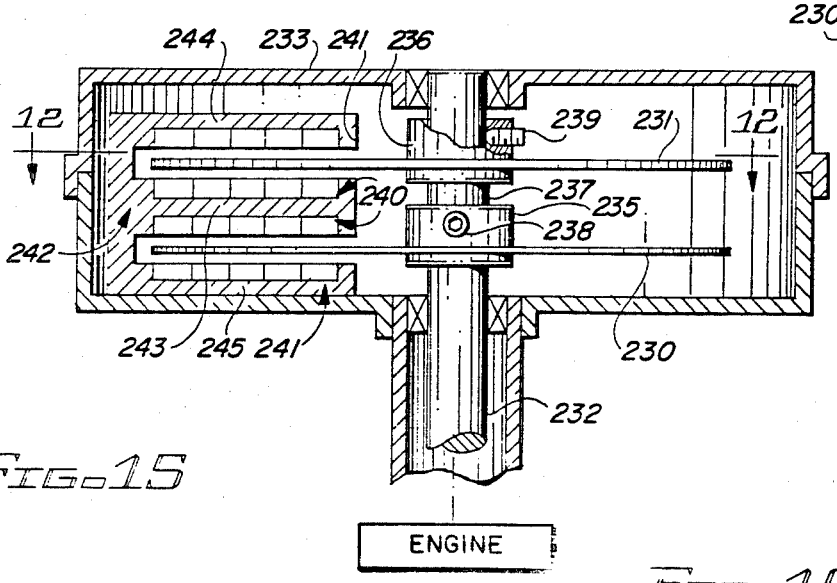
FIG. 15 is a view similar to FIG. 14 and illustrating a two-disk variant of the subsystem.

Component size constraints and considerations of assembly rigidity for long term reliability, as well as consideration of how small the individual tracks and sensors in a multi-band disk can reasonably be economically fabricated, are minor (but meaningful) drawbacks to the assembly illustrated in FIG. 13. Such minor drawbacks are all overcome by employing the embodiment of the invention illustrated in FIG. 15 in which timing information for an eight cylinder engine is obtained through the use of two axially spaced five band disks such as that illustrated in FIG. 12. As shown in FIG. 15, lower disk 230 and upper disk 231 are carried by shaft 232 for rotation within a housing 233. Each of the disks 230, 231 correspond to the four cylinder disk 130 illustrated in FIG. 12.

Figure 16:
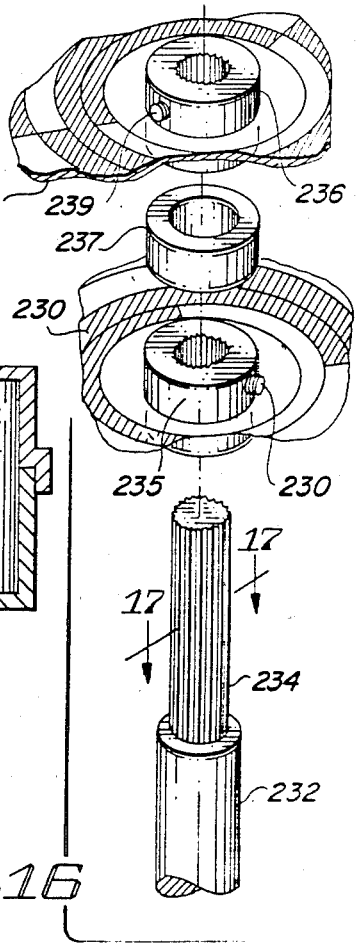
FIG. 16 is a partial and exploded view of the two disk assembly illustrated in FIG. 15 and particularly showing one means for establishing and maintaining the skewed timing relationship between the two disks.

They are, however, circumferentially skewed with respect to one another by forty-five degrees to obtain the eight different timing relationships for the individual cylinders. A simple means for accomplishing this adjustment is better illustrated in FIG. 16 in which it will be noted that the shaft 232 has an upper end section 234 which is splined. The disks 230, 231 includes respective internally splined hubs 235, 236 to receive the splined end section 234 of the shaft 232 with their axial displacement determined by a spacer 237. The splined distribution end 234 of the shaft 232 may be provided with as many points as may be useful for a given installation. In order to achieve a forty-five degree circumferential skew between the two disks 230, 231 in the exemplary eight cylinder assembly shown in FIG. 15, the number of splines will be eight or a multiple of eight. Once the hubs 235, 236 have been situated on the spline end 234 of the shaft 232 in their correct angular and axial positions, set screws 238, 239 may be tightened to make the adjustment permanent. Those skilled in the art will appreciate that juxtaposing the two disks 230, 231 may be carried out in any number of approaches such as fabricating the assembly as a unit.

In the configuration shown in FIG. 15, the light source arrays 240 and light sensor arrays 241 are supported in an E-shaped structure 242 characterized by legs slightly in excess of half the length of the legs of the C-shaped structure 223 illustrated in FIG. 13. More particularly, the two light source arrays 240 are preferably both carried on the central leg 243 of the E-shaped structure 242 and are directed one upwardly and one downwardly. Correspondingly, one light sensor array 241 is carried by the upper leg 244 of the E-shaped structure 242 and the other light sensor array 241 is carried by the lower leg 245 of the E-shaped structure. With this configuration, smaller diameter disks are used in conjunction with a more rigid light source/light sensor assembly with a consequent reduction in the space required while achieving improved reliability. For engines having a multitude of cylinders, three or even more axially spaced disks may be employed with a corresponding support assembly for the requisite light source and light sensor arrays.

Since the several coils in a distributorless system as described are not individually subjected to the continuous demands imposed on a single-coil system, smaller and faster coils (than those now deemed to be conventional) can be employed, thus permitting the use of a higher frequency pulse stream with a consequent further increase in system efficiency and capability.

While the principles of the invention have now been made clear in illustrative embodiments, there will be immediately obvious to those skilled in the art many modifications of structure, arrangements, proportions, the elements, materials, and components, used in the practice of the invention which are particularly adapted for a specific environment and operating requirements without departing from those principles.

I claim:

1. A spark ignition system for a multi-cylinder internal combustion engine comprising:

(A) a free running source of pulses which periodically switch between logic "high" and logic "low" levels;

(B) engine angular position sensing means for generating a plurality of cylinder position timing signals, each said cylinder position timing signal being characterized by the presence of a first logic level when a unique cylinder is within a first engine position angular range and, by the presence of a second logic level when said unique cylinder is within a second engine position angular range which does not include said first engine position angular range, said first engine angular position range corresponding to at least a portion of the power stroke of said unique cylinder, said engine angular position sensing means including:

1. a shaft rotating at a rate directly proportional to engine speed;
2. a disk coaxially disposed with respect to said shaft and rotating therewith, said disk having a plurality of radially distributed circular bands, each said band characterized by circumferentially arranged alternating opaque sectors and translucent sectors;
3. a plurality of light sensors;
4. at least one light source spaced from and directed toward said light sensors; and
5. means fixing the positions of each said light sensor and said at least one light source with respect to one another and with respect to said disk such that each said band of said disk extends into the space between said at least one light source and one of said light sensors thereby alternating blocking and passing light from said at least one light source to said one light sensor as said shutter assembly rotates with said shaft;

(c) a plurality of triggerable sources of intermittent high voltage pulses, each said triggerable source having an output delivering a single high voltage pulse each time it is triggered, each said triggerable source comprising an ignition coil, each said ignition coil including a low voltage primary winding and a high voltage secondary winding;

(D) a plurality of trigger signal developing means having an input and an output, each said trigger signal developing means output being connected to one of said triggerable sources and adapted to trigger said one triggerable source in response to the transition of a signal between logic "low" and logic "high" appearing at said input to said trigger signal developing means, each said trigger signal developing means including an electronic switch disposed in series with said primary winding of one of said ignition coils and a d-c electrical power source such that, when said electronic switch is closed, current from said power source passes through said primary winding of said one ignition coil to generate a magnetic field and when said electronic switch is opened, the magnetic field collapses to induce a high voltage pulse in said secondary winding of said one ignition coil;

(E) a plurality of gating means, each said gating means having:
1. an output coupled to said input of one of said triggerable signal developing means;
2. a first input coupled to receive one of said cylinder position timing signals; and
3. a second input coupled to receive pulses from said free running source; each said gating means being responsive to the presence of said first logic level in said cylinder position timing signal coupled thereto to pass said pulses from said free running source to said input of said one trigger signal development means coupled thereto and to the presence of said second logic level in said cylinder position timing signal coupled thereto to prevent said pulses from said free running source from being applied to said input of said one trigger signal development means coupled thereto; and (F) means for transferring a high voltage pulse generated by the one of said triggerable sources coupled to said one trigger signal developing means to a spark plug in said unique cylinder to be fired when said engine angular position sensing means senses that the instantaneous engine angular position falls within said first angular range for said unique cylinder.

2. A spark ignition system for a multi-cylinder internal combustion engine comprising:

(A) a free running source of pulses which periodically switch between logic "high" and logic "low" levels;

(B) engine angular position sensing means for generating a plurality of cylinder position timing signals, each said cylinder position timing signal being characterized by the presence of a first logic level when a unique cylinder is within a first engine position angular range and, by the presence of a second logic level when said unique cylinder is within a second engine position angular range which does not include said first engine position angular range, said first engine angular position range corresponding to at least a portion of the power stroke of said unique cylinder, said engine angular position sensing means including:
1. a shaft rotating at a rate directly proportional to engine speed;
2. a disk coaxially disposed with respect to said shaft and rotating therewith, said disk having a plurality of radially distributed circular bands, each said band characterized by circumferentially arranged alternating opaque sectors and translucent sectors;
3. a plurality of light sensors;
4. a plurality of light sources, each said light source spaced from and directed toward one of said light sensors; and
5. means fixing the positions of each said light sensor and each said light source with respect to one another and with respect to said disk such that each said band of said disk extends into the space between one of said light sources and one of said light sensors thereby alternating blocking and passing light from said one light source to said one light sensor as said shutter assembly rotates with said shaft;

(C) a plurality of triggerable sources of intermittent high voltage pulses, each said triggerable source having an output delivering a single high voltage pulse each time it is triggered;

(D) a plurality of trigger signal developing means having an input and an output, each said trigger signal developing means output being connected to one of said triggerable sources and adapted to trigger said one triggerable source in response to the transition of a signal between logic "low" and logic "high" appearing at said input to said trigger signal developing means;

(E) a plurality of gating means, each said gating means having:
1. an output coupled to said input of one of said triggerable signal developing means;
2. a first input coupled to receive one of said cylinder position timing signals; and
3. a second input coupled to receive pulses from said free running source; each said gating means being responsive to the presence of said first logic level in said cylinder position timing signal coupled thereto to pass said pulses from said free running source to said input of said one trigger signal development means coupled thereto and to the presence of said second logic level in said cylinder position timing signal coupled thereto to prevent said pulses from said free running source from being applied to said input of said one trigger signal development means coupled thereto; and (F) means for transferring a high voltage pulse generated by the one of said triggerable sources coupled to said one trigger signal developing means to a spark plug in said unique cylinder to be fired when said engine angular position sensing means senses that the instantaneous engine angular position falls within said first angular range for said unique cylinder.

3. A spark ignition system for a multi-cylinder internal combustion engine comprising:

(A) a free running source of pulses which periodically switch between logic "high" and logic "low" levels;

(B) engine angular position sensing means for generating a plurality of cylinder position timing signals, each said cylinder position timing signal being characterized by the presence of a first logic level when a unique cylinder is within a first engine position angular range and, by the presence of a second logic level when said unique cylinder is within a second engine position angular range which does not include said first engine position angular range, said first engine angular position range corresponding to at least a portion of the power stroke of said unique cylinder, said engine angular position sensing means including:

1. a shaft rotating at a rate directly proportional to engine speed;
2. a plurality of disks coaxially disposed with respect to said shaft and rotating therewith, each said disk having a plurality of radially distributed circular bands, each said band characterized by circumferentially arranged alternating opaque sectors and translucent sectors;
3. a plurality of light sensor;
4. at least one light source spaced from and directed toward said light sensors; and
5. means fixing the positions of each said light sensor and said at least one light source with respect to one another and with respect to one of said disks such that each said band of said one disk extends into the space between said at least one light source and one of said light sensors thereby alternating blocking and passing light from said at least one light source to said one light sensor as said shutter assembly rotates with said shaft;

(C) a plurality of triggerable sources of intermittent high voltage pulses, each said triggerable source having an output delivering a single high voltage pulse each time it is triggered;

(D) a plurality of trigger signal developing means having an input and an output, each said trigger signal developing means output being connected to one of said triggerable sources and adapted to trigger said one triggerable source in response to the transition of a signal between logic "low" and logic "high" appearing at said input to said trigger signal developing means;

(E) a plurality of gating means, each said gating means having:

1. an output coupled to said input of one of said triggerable signal developing means;
2. a first input coupled to receive one of said cylinder position timing signals; and
3. a second input coupled to receive pulses from said free running source; each said gating means being responsive to the presence of said first logic level in said cylinder position timing signal coupled thereto to pass said pulses from said free running source to said input of said one trigger signal development means coupled thereto and to the presence of said second logic level in said cylinder position timing signal coupled thereto to prevent said pulses from said free running source from being applied to said input of said one trigger signal development means coupled thereto; and (F) means for transferring a high voltage pulse generated by the one of said triggerable sources coupled to said one trigger signal developing means to a spark plug in said unique cylinder to be fired when said engine angular position sensing means senses that the instantaneous engine angular position falls within said first angular range for said unique cylinder.

4. A spark ignition system for a multi-cylinder internal combustion engine comprising:

(A) a free running source of pulses which periodically switch between logic "high" and logic "low" levels, said free running source including:

1. a free running oscillator issuing a continuous stream of clock pulses; and
2. a digital frequency divider connected to receive clock pulses from said oscillator and adapted to respond thereto by issuing a single pulse each time a predetermined number of clock pulses has been received;

(B) engine angular position sensing means for generating a plurality of cylinder position timing signals, each said cylinder position timing signal being characterized by the presence of a first logic level when a unique cylinder is within a first engine position angular range and, by the presence of a second logic level when said unique cylinder is within a second engine position angular range which does not include said first engine position angular range, said first engine angular position range corresponding to at least a portion of the power stroke of said unique cylinder;

(C) a plurality of triggerable sources of intermittent high voltage pulses, each said triggerable source having an output dlivering a single high voltage pulse each time it is triggered;

(D) a plurality of trigger signal developing means having an input and an output, each said trigger signal developing means output being connected to one of said triggerable sources and adapted to trigger said one triggerable source in response to the transition of a signal between logic "low" and logic "high" appearing at said input to said trigger signal developing means;

(E) a plurality of gating means, each said gating means having:

1. an output coupled to said input of one of said triggerable signal developing means;
2. a first input coupled to receive one of said cylinder position timing signals; and
3. a second input coupled to receive pulses from said free running source; each said gating means being responsive to the presence of said first logic level in said cylinder position timing signal coupled thereto to pass said pulses from said free running source to said input of said one trigger signal development means coupled thereto and to the presence of said second logic level in said cylinder position timing signal coupled thereto to prevent said pulses from said free running source from being applied to said input of said one trigger signal development means coupled thereto; and (F) means for transferring a high voltage pulse generated by the one of said triggerable sources coupled to said one trigger signal developing means to a spark plug in said unique cylinder to be fired when said engine angular position sensing means senses that the instantaneous engine angular position falls within said first angular range for said unique cylinder.

5. A spark ignition system for a multi-cylinder internal combustion engine comprising:

(A) a free running source of pulses which periodically switch between logic "high" and logic "low" levels;

(B) engine angular position sensing means for generating a plurality of cylinder position timing signals, each said cylinder position timing signal being characterized by the presence of a first logic level when a unique cylinder is within a first engine position angular range and, by the presence of a second logic level when said unique cylinder is within a second engine position angular range which does not include said first engine position angular range, said first engine angular position range corresponding to at least a portion of the power stroke of said unique cylinder;

(C) a plurality of triggerable sources of intermittent high voltage pulses, each said triggerable source having an output delivering a single high voltage pulse each time it is triggered;

(D) a plurality of trigger signal developing means having an input and an output, each said trigger signal developing means output being connected to one of said triggerable sources and adapted to trigger said one triggerable source in response to the transistion of a signal between logic "low" and logic "high" appearing at said input to said trigger signal developing means;

(E) a plurality of gating means, each said gating means having:

1. an output coupled to said input of one of said triggerable signal developing means;
2. a first input coupled to receive one of said cylinder position timing signals; and
3. a second input coupled to receive pulses from said free running source; each said gating means being responsive to the presence of said first logic level in said cylinder position timing signal coupled thereto to pass said pulses from said free running source to said input of said one trigger signal development means coupled thereto and to the presence of said second logic level in said cylinder position timing signal coupled thereto to prevent said pulses from said free running source from being applied to said input of said one trigger signal development means coupled thereto;

(F) means for transferring a high voltage pulse generated by the one of said triggerable sources coupled to said one trigger signal developing means to a spark plug in said unique cylinder to be fired when said engine angular position sensing means senses that the instantaneous engine angular position falls within said first angular range for said unique cylinder; and (G) alternative operation means for selectively enabling a service mode of operation, in which said service mode of operation a single triggering pulse is coupled to said triggerable source each time said first logic level is present, said alternative operation means comprising:

1. a pulse developer adapted to issue said single pulse in response to each concurrence of:
   a. said first logic level; and
   b. the presence of the first pulse issued by said source of pulses occurring after said first logic level is present.

* * * * *